US007050707B1

(12) United States Patent
Lin

(10) Patent No.: US 7,050,707 B1
(45) Date of Patent: May 23, 2006

(54) HEATER DEVICE FOR DESICCANT ROTOR DEHUMIDIFIER

(75) Inventor: Ching-Hwa Lin, Hsinchu (TW)

(73) Assignee: Norm Pacific Automation Corp., Hsinchu (TW)

( * ) Notice: Subject to any disclaimer, the term of this patent is extended or adjusted under 35 U.S.C. 154(b) by 0 days.

(21) Appl. No.: 11/144,828

(22) Filed: Jun. 6, 2005

(30) Foreign Application Priority Data

Mar. 31, 2005 (TW) ..... 94110404 A

(51) Int. Cl.
*F24H 3/02* (2006.01)

(52) U.S. Cl. ..... 392/360; 392/347; 392/361

(58) Field of Classification Search ..... None
See application file for complete search history.

(56) References Cited

U.S. PATENT DOCUMENTS 4,729,774 A * 3/1988 Cohen et al. ..... 96/123
6,622,508 B1 * 9/2003 Dinnage et al. ..... 62/271
2002/0129614 A1 * 9/2002 Dinnage et al. ..... 62/271
2004/0134211 A1 * 7/2004 Lee et al. ..... 62/271
2005/0252229 A1 * 11/2005 Moratalla ..... 62/271
2005/0262720 A1 * 12/2005 Rane et al. ..... 34/330

FOREIGN PATENT DOCUMENTS

JP 2003-38930 2/2003

* cited by examiner

*Primary Examiner*—Thor S. Campbell
(74) *Attorney, Agent, or Firm*—Harness, Dickey & Pierce

(57) ABSTRACT

A heater device applied in a desiccant rotor dehumidifier for supplying regeneration hot air to the desiccant rotor comprises a metal case having an air inlet and an air outlet; heating elements supported by insulative material and mounted adjacent to the desiccant rotor; and an insulative plate installed in parallel to the heating elements and parting the heating elements with the air inlet. The insulative plate is formed with a plurality of via holes suitably distributed for the intake air coming from the air inlet passing through, being heated by the heating elements and evenly passing the desiccant rotor through the air outlet. The insulative plate also splits and bypasses a part of the intake air to cool down the desiccant rotor that has been heated and regenerated.

8 Claims, 4 Drawing Sheets

HEATER DEVICE FOR DESICCANT ROTOR DEHUMIDIFIER

FIELD OF THE INVENTION

The invention generally relates to a heater device applicable to a desiccant rotor dehumidifier, and in particular relates to a heater device having an insulative plate formed with multiple via holes to prevent thermal loss and to guide airflow evenly passing through heating elements.

BACKGROUND OF THE INVENTION

The invention relates to a heater device applicable to desiccant rotor dehumidifier. The working principle of a desiccant rotor dehumidifier is shown in FIG. 1, the dehumidifier D mainly includes a heat-exchanger (water condenser) 1, a desiccant wheel 2, a first fan 3, a second fan 4, a heater device 5 and a tank 6. The drawing does not show the case, frame and control device. An exterior airflow A0 driven by the first fan 3 passes the exterior of the heat-exchanger 1 (airflow A1), a humidity-absorbing region 22 of the desiccant rotor 2 (airflow A2) and blown out through the first fan 3 (airflow A3). An internal airflow driven by the second fan 4 (airflow B4) passes through the heater 5 (airflow B1), a regeneration region 21 of the desiccant rotor 2 (airflow B2), the interior of the heat-exchanger 1 (airflow B3) and returns to the second fan 4 and cycles. The heat-exchanger 1 is mainly a hollow plastic or metallic tube (manifold) member having an inlet 110 and an outlet 12 connecting respectively to the regeneration region 21 of the desiccant rotor 2 and an inlet of the second fan 4 so that the warm and humid airflow A3 inside the manifold and the airflow A0 passing through exterior of the manifold takes heat-exchange. Water 16 is then condensed and collected to the tank 6. The desiccant rotor 2 is a disc-like honeycomb ceramic substrate coated or compounded with desiccant (usually zeolite or silica gel). An unshown driving unit drives the desiccant rotor (in direction R as illustrated) with a suitable speed turning into the regeneration region 21 (corresponding to the heater 5 position) and out for the humidity-absorbing region 22. At the humidity-absorbing region 22, the exterior airflow A1 passing through the honeycomb pores of the desiccant rotor 2 leaves humidity in the desiccant. Then, at the regeneration region 21, the humidity in the rotor 2 is dried out by the circulated airflow passing through the heater 5 (the warm airflow B1) and becomes warm and humid airflow B2 to be condensed in the heat-exchanger 1 after passing through a collector 11 into the heat-exchanger 1. The relatively dehumidified airflow B3 is further driven back by the second fan 4 (airflow B4) and expelled into the heater 5 to become warm airflow B1 for regenerating the desiccant rotor 2. So the cycles proceed.

The heater device mainly includes heating wire or similar elements for heating the airflow. In order to improve heating efficiency, the airflow output has to be uniform for the regeneration region, and prevented from external thermal loss. FIG. 4 is a prior heater device disclosed in Japan Laid-open Patent No. 2003-38930. The heating unit 9 includes a heating element 9*a* installed inside a case 9*b*. A blower (fan) 7 provides warm air via the heating element 9*a* to a desiccant rotor 2. A shield plate 9*c* located between the heating element 9*a* and the case 9*b* shields the direct thermal radiation of the heating element to the case. The shield plate 9*c* keeps an air gap to the case 9*b* so as to decrease indirect thermal loss. The shield plate 9*c* has shiny surface for reflecting the thermal radiation of the heating element 9*a*. An inclination 9*e* is formed on the shield plate 9*c* to guide the airflow toward the heating element 9*a*. Though the construction can save thermal loss, the airflow passing through the heating element 9*a* is not controlled of its uniformity. Further, the shield plate 9*c* is usually made of metal. As a result, the supporting means for the heating element 9*a* (usually bare heating wire) have to be well electrically insulated that cause the assembly more complicated and costly.

Therefore, it is a great demand to have a heating device with simple structure, less thermal loss and uniform airflow output.

SUMMARY OF THE INVENTION

The major object of the invention is to provide a heating device applicable to desiccant rotor dehumidifier that can prevent thermal loss.

Another object of the invention is to provide a heating device applicable to desiccant rotor dehumidifier that can provide uniform airflow output.

A further object of the invention is to provide a heating device applicable to desiccant rotor dehumidifier that has simple construction.

To achieve the aforesaid objects, a heater device applied in a desiccant rotor dehumidifier for supplying regeneration hot air to the desiccant rotor comprises a metal case having an air inlet and an air outlet; heating elements supported by insulative material and mounted adjacent to the desiccant rotor; and an insulative plate installed in parallel to the heating elements and parting the heating elements with the air inlet. The insulative plate is formed with a plurality of via holes suitably distributed for the intake air coming from the air inlet passing through, being heated by the heating elements and evenly passing the desiccant rotor through the air outlet. Since the insulative plate shields the thermal radiation of the heating elements to the heater case, and the air intake passing through the via holes of the insulative plate removes the heat received from the heating elements, therefore, the thermal loss is less. The via holes on the insulative plate also makes the airflow output uniform. The insulative plate and the insulative material for supporting the heating elements are made of mica or the like, which are non-metal and make the electrical insulation easy and simple. The insulative plate also splits and bypasses a part of the intake air to cool down the desiccant rotor that has been heated and regenerated.

BRIEF DESCRIPTION OF THE DRAWINGS

The invention will become more fully understood from the detailed description given hereinbelow. However, this description is for purposes of illustration only, and thus is not limitative of the invention, wherein:

FIG. 1 is an explanatory view of a desiccant rotor dehumidifier that the heater device of the invention applicable to;

DETAILED DESCRIPTION OF THE INVENTION

Figure 1:
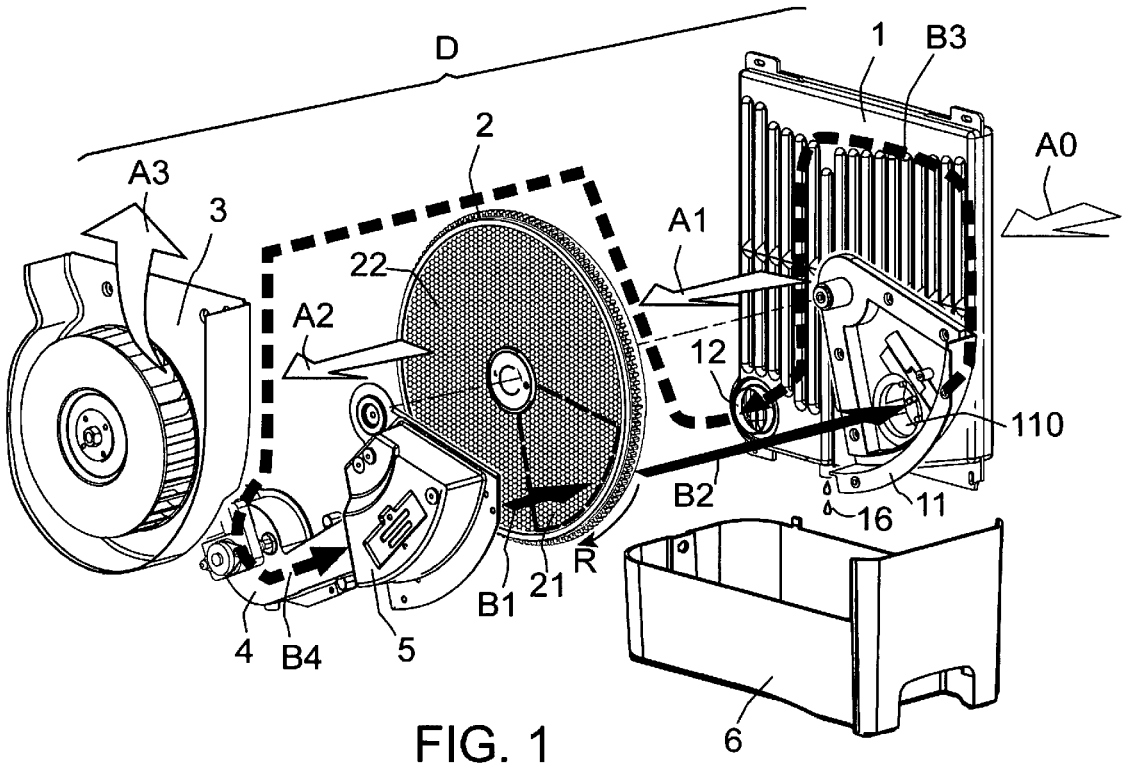
Figure 2:
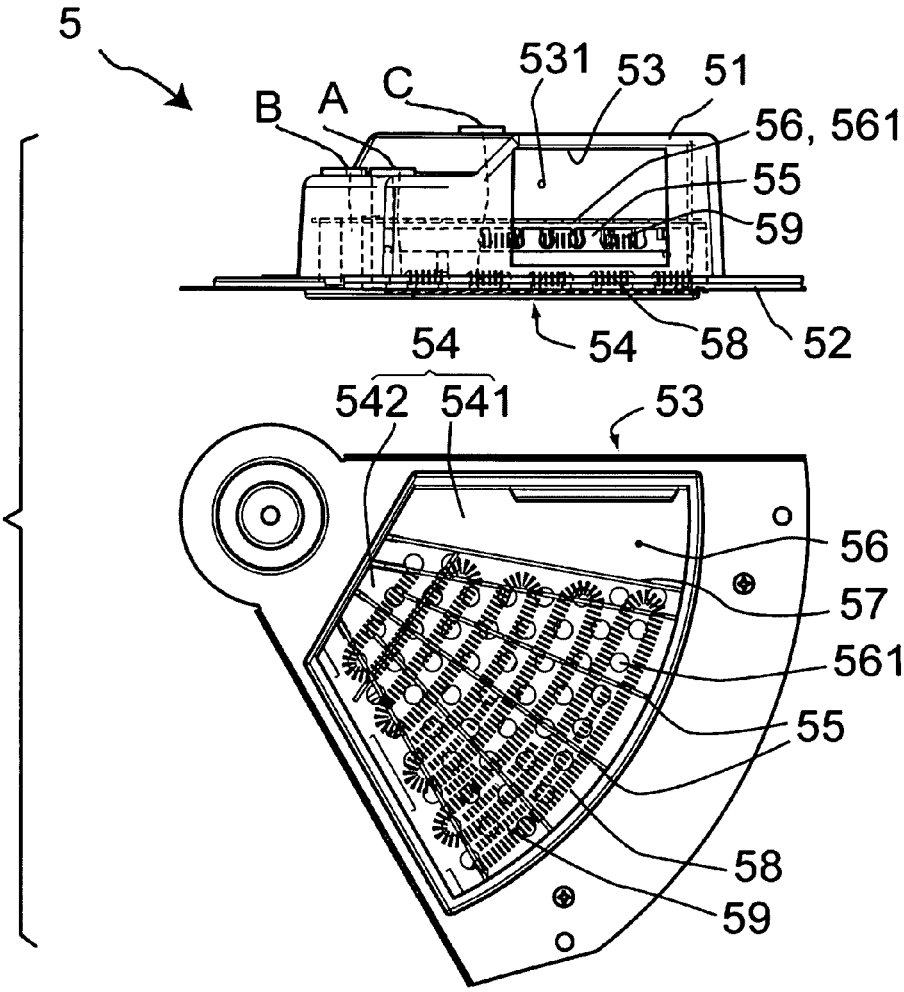
FIG. 2 is an orthographical view of a heater device of an embodiment of the invention.

FIG. 2 is an orthographical view of a heater device of an embodiment of the invention taken from air inlet and air outlet directions. The heater device 5 is composed of a box 51 and a cover 52, which are preferably made of metal for fire retardancy. The box 51 is formed with an air inlet 53 connecting to the airflow provided by the second fan 4 (FIG. 1). The cover 52 is formed with an air outlet 54 connecting to the regeneration region 21 of the desiccant rotor 2 (FIG. 1). The box 51 and the cover 52 form a cavity for holding a supporter 55 composed of thermal insulative material (such as mica) components to support heating elements (such as two heating wires 58, 59) at a position adjacent to the air outlet 54. An insulative plate 56 fixed in parallel to the heating elements 58, 59 and parts the heating elements and the air inlet 53. The insulative plate 56 is formed with a plurality of via holes 561 suitably distributed for the airflow coming from the air inlet 53, and through an air passage 531, to pass through to the heating elements 58, 59 for being heated and passing through the air outlet 54 uniformly to the desiccant rotor. In the embodiment, the heating elements are two heating wires 58, 59 arranged in two layers in parallel to the air outlet 54 (in order to show the via holes 561, the heating wire 59 is not fully shown in the drawing) and having terminals A, B and C (a common end) connecting to external powers for high and low wattage selections. The heating elements 58, 59 are arranged in a fan-shaped area for proving uniform heating to the rotating and interchanging regeneration region 21 of the desiccant rotor 2. The fan-shaped area of the heating elements 58, 59 is arranged on one side of the air outlet 54 as a heating region 542. Aside the heating region 542, there is a cooling region 541 where a part of intake air from the air inlet 53 is bypassed by the shield plate 56 (i.e. via another side of the air passage 531) for cooling the desiccant rotor 2. A parting plate 57 is also formed to part the cooling region 541 from the heating region 542. Therefore, along the rotation direction of the desiccant rotor 2, the desiccant rotor 2 is first regenerated at the heating region 542, then cooled at the cooling region 541 for further use of humidity absorption. Of course, in practice, the fan-shaped area of the heating elements 58, 59 can cover the whole air outlet 54. In other words, no cooling region 541 is included.

Figure 3:
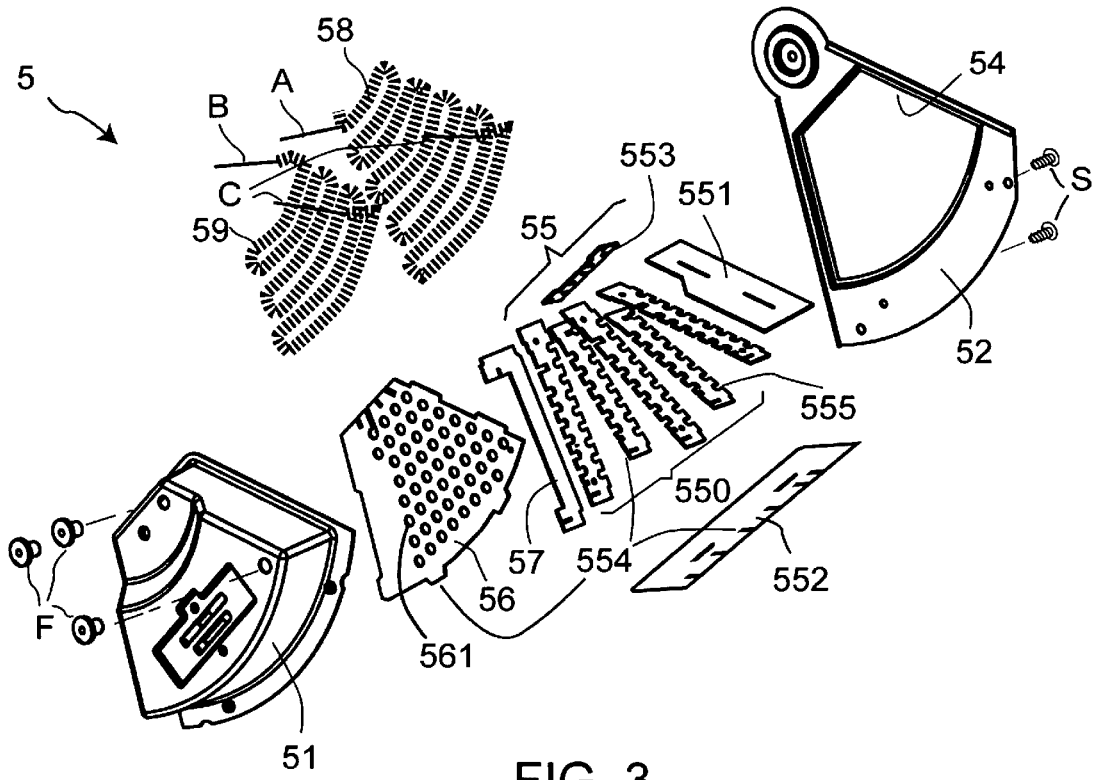
FIG. 3 is an exploded view of a heater device of an embodiment of the invention.
Figure 4:
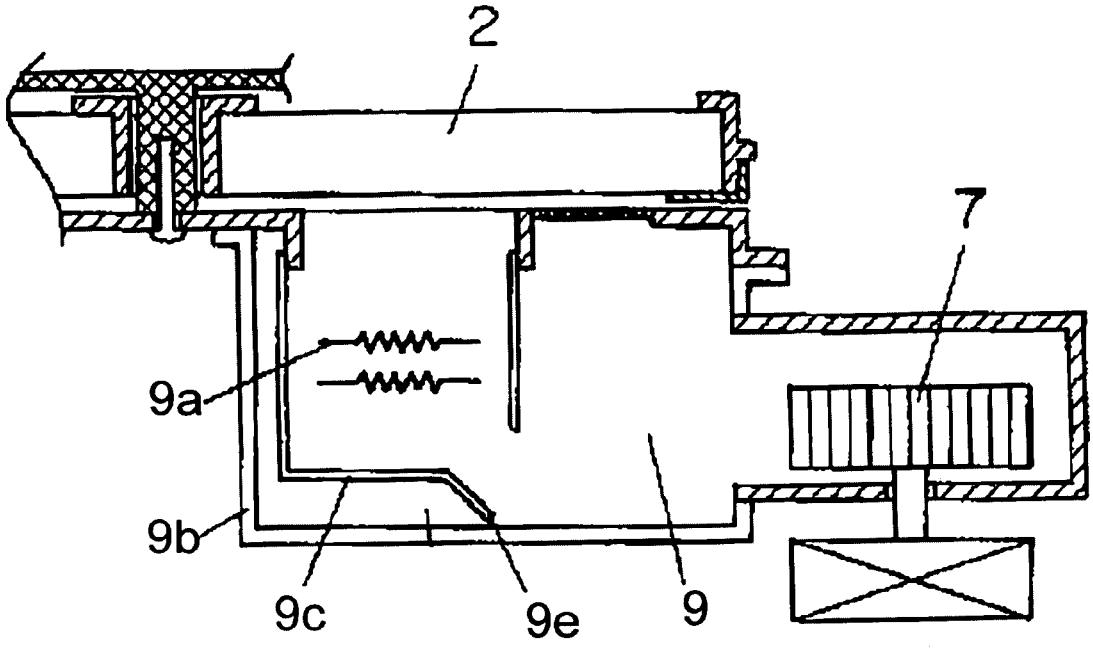
FIG. 4 (PRIOR ART)
FIG. 4 is a schematic view of a heating unit of prior art.

FIG. 3 is an exploded view of a heater device of an embodiment of the invention. The heater device 5 includes a case composed of a box 51 and a cover 52 fastened to each other with screws S. The other components: a supporter 55, an insulative plate 57, a parting plate 57 and heating elements 58, 59, are enclosed in the case. The heating elements 58, 59 are mounted on the supporter 55, which is made of thermal enduring and electrically insulative materials, such as mica or ceramic. The supporter 55 is composed of several main components 550 having grooves 555 at the rims for holding the heating elements 58, 59. The main components 555 are fastened with side components 551, 552, 553, the insulative plate 56 and the parting plate 57 through groove and extrusion engagements 554 to form a unit fitted in the cavity enclosed by the box 51 and the cover 52. Terminals A, B and C of the heating elements 58, 59 are protected by insulative sleeves F to leave the box 51 and connected to electrical power source (not shown in the drawing). The two sets of heating elements 58, 59 are for two-stage wattage selections. In practice, a single or multiple heating elements and any suitable power modulation method can be applied.

The characteristics of the invention are that the insulative plate and the side components of the supporter of heating elements can shield the thermal radiation of the heating elements to the heater case; the air intake passing through the via holes of the insulative plate removes the heat received from the heating elements, therefore, the thermal loss to the exterior is less; the via holes on the insulative plate also makes the airflow output uniform so as to improve the regeneration efficiency for the desiccant rotor; the size and positions of the via holes can also be adjusted according to the characteristics and positions of the heating elements; the insulative plate and the insulative material for supporting the heating elements are made of mica or the like, which are non-metal and make the electrical insulation easy and simple; a part of the insulative plate also splits and bypasses a part of the intake air to cool down the desiccant rotor that has been heated and regenerated, therefore, the regeneration efficiency is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heater device applied in a desiccant rotor dehumidifier having a heat-exchanger, a desiccant rotor, a first fan and a second fan for supplying regeneration hot air to said desiccant rotor, comprising:

a case having an air inlet receiving airflow from said second fan, an air outlet mounted adjacent to a portion of said desiccant rotor, and a cavity formed between said air inlet and said air outlet;

at least a heating element, located in said cavity and adjacent to said air outlet; and an insulative plate installed in parallel to said heating element and parting said heating element with said air inlet, and said insulative plate is formed with a plurality of via holes suitably distributed for said airflow coming from said air inlet passing through, being heated by said heating elements and evenly passing said desiccant rotor through said air outlet.

2. The heater device of claim 1, wherein said via holes are evenly distributed.

3. The heater device of claim 1, wherein said via holes are arranged relatively to said heating element.

4. The heater device of claim 1, wherein said heating element is supported by a supporter made of thermal enduring and electrically insulative material.

5. The heater device of claim 4, wherein said supporter comprises main components for supporting said heating element and side members around said main members for preventing thermal loss through said case.

6. The heater device of claim 4, wherein said supporter and said insulative plate are made of mica.

7. The heater device of claim 1, wherein a part of said insulative plate further splits and bypasses a part of said airflow coming from said second fan to cool down said desiccant rotor that has been heated and regenerated.

8. The heater device of claim 7, further comprises a parting plate mounted adjacent to said air outlet to part said cooling airflow from said heating airflow passing through said heating element.

* * * * *